US006418578B1

(12) United States Patent
Polevoy et al.

(10) Patent No.: US 6,418,578 B1
(45) Date of Patent: Jul. 16, 2002

(54) PROTECTIVE GUARD FOR FURNITURE LEG

(75) Inventors: Richard Polevoy, Teaneck, NJ (US); Howard Scott Ryan; Paul Eric Carlson, both of Skaneateles, NY (US)

(73) Assignee: Finger Lakes Intellectual Property, LLC, Teaneck, NJ (US)

( * ) Notice: Subject to any disclaimer, the term of this patent is extended or adjusted under 35 U.S.C. 154(b) by 0 days.

(21) Appl. No.: 09/536,342

(22) Filed: Mar. 25, 2000

(51) Int. Cl.[7] ..... A47G 19/02; B60B 33/00

(52) U.S. Cl. ..... 5/200.1; 5/663; 16/18 CG; 248/345.1

(58) Field of Search ..... 5/663, 658, 200.1, 5/201, 202; 16/18 CG; 248/345.1; D6/375

(56) References Cited

U.S. PATENT DOCUMENTS 1,595,582 A * 8/1926 Stedman ..... 248/345.1
4,323,610 A * 4/1982 Leverich ..... 428/68
D274,788 S * 7/1984 Simonsen ..... D6/375
5,173,990 A * 12/1992 Owen ..... 5/663
5,371,920 A * 12/1994 Rainville ..... 16/18 CG
5,603,140 A * 2/1997 Pryce ..... 248/345.1
5,873,144 A * 2/1999 Tupper et al. ..... 16/18 CG
5,924,165 A * 7/1999 Gierer et al. ..... 16/18 CG
5,945,178 A * 8/1999 Volkmann ..... 248/188
6,125,504 A * 10/2000 Richards ..... 16/18 CG
6,332,240 B1 * 12/2001 Wu ..... 16/18 CG

* cited by examiner

*Primary Examiner*—Alexander Grosz
(74) *Attorney, Agent, or Firm*—Klauber & Jackson

(57) ABSTRACT

A protective guard is disclosed that is particularly adapted for use with a bed frame. The guard is adapted to fit over an existing leg of the bed frame and has a specially shaped opening in the upper surface into which the leg of the bed frame can fit. A caster assembly has an upstanding stem that passes the existing leg in the leg structure and holds the protective guard in position affixed to the bed frame. The protective guard is shaped in a variety of configurations and surface markings so as to be adapted to fit the décor of the room in which it is used. In addition, the overall shape of the protective guard covers the leg of the bed frame to provide protection against injury from the inadvertent bumping of the bed frame leg by persons walking or standing near the bed frame. In one embodiment, the protective guard is an integrated shield and a caster assembly that is affixed to the leg of the bed frame and provides a protective plastic covering for the caster assembly as well as the leg.

29 Claims, 11 Drawing Sheets

PROTECTIVE GUARD FOR FURNITURE LEG

BACKGROUND OF THE INVENTION

The present invention relates to a protective device for use with a leg assembly of a piece of furniture and, more particularly, to a protective and decorative guard that can readily be installed to enclose the leg of a bed frame and protect all sharp edges. The ultimate goal is to fully protect and encapsulate all exposed metal edges of the entire frame.

In general, bed frames are well known and are comprised of a pair of side rails and various cross members that interconnect the side rails and prove a relatively rigid structure of predetermined dimensions in order to support a box spring and a mattress. The common rail structure is an L-shaped steel member and various manners of connecting the individual components together are available.

The various components, that is, the side rails and the cross members are also generally provided with legs or supports that extend downwardly from the side rail or cross member and are supported by a planar surface such as a floor. Such legs can include casters so that the components of the bed frame are elevated from the floor and to allow the bed frame and completed bed to be moved to differing locations in the room.

Accordingly, the legs normally have casters to facilitate the movement of the bed from one location to another and, in general, support the bed frame which, in turn, provides support for the box spring and mattress. As is known, the bed frame leg, along with the caster, is generally visible and can be seen by persons in the vicinity of the bed unless the bed coverings are such that they extend downwardly sufficiently to hide the leg and caster.

In the absence of the bed covers that hide the legs of the bed frame, however the legs themselves are generally constructed of one or more steel stampings and are not particularly attractive components of the overall bed. It would, therefore, be advantageous to somehow cover up the legs of the bed frame in a more permanent fashion and, at the same time, provide some attractive decoration to the leg and the bed so that it actually enhances the overall appearance of the bed rather than detract from that appearance.

In addition, the normal legs of such bed frames are located at the outer perimeter of the bed frame and are thus susceptible of being kicked or generally run into by persons walking near the bed. Since the typical leg of a bed frame is composed of steel members that may have relatively sharp protrusions, it can be quite painful for a person to encounter and bump into a portion of the bed frame leg. Again, therefore, it would be advantageous if the bed frame legs could have some protective means to prevent injury to persons that hit the assembly with their feet, ankles or shins in walking near the bed or attending to making or changing the bed.

One prior art protector for bed supports and casters is disclosed in Owen, U.S. Pat. No. 5,173,990 where the protector device is comprised of a generally resilient material and which has a radially disposed cut that enables the device to circumvallate the entire bed leg, including the caster, so that the caster is enclosed within the sleeve-like protector and, as such, impedes the mobility of the bed. That mobility is impeded, in part, since bed frame casters typically have an offset that requires the caster to swivel in order to move the bed and thus anything that affects the swiveling action impedes the overall mobility of the bed.

Too, in the Owen device, the protector is retained on the bed support and caster by its own resiliency, and in time, can lose its resiliency and the device would become loose and require replacing. In particular, the Owen protector is held in place longitudinally by compressing the elastic material between the floor and the bed same side rail. Therefore, aside from a loss of resilience and durability factors over time, the Owen device inherently seems to impede the movement of the caster, especially on a carpeted floor.

It would be advantageous if the protector would not only provide protection from inadvertent encounters with the lower portion of the users leg, be decorative, but at the same time be useable with the stamped metal bed frame legs and additionally be compatible with the normal casters or glide assemblies, that is, to be usable without sacrificing any of the full use of the caster itself or be specially designed to be used with a particular caster that is itself an improvement on current casters and glide assemblies.

In addition, since the typical bed frame caster itself has exposed metal edges that can be a hazard if kicked or otherwise contacted, it would be advantages to have a caster incorporated into a leg guard that would provide the mobility of a caster but additionally provide protection to a user from encountering the caster itself, as well as the leg of the bed frame.

SUMMARY OF THE INVENTION

Now, in accordance with the present invention, an improved guard or protective device is shown that is usable with furniture and particularly to a bed frame such that the device is easily interfitted to the bed frame leg itself and which provides both a decorative addition to the overall bed assembly as well as provides protection against harm due to inadvertent contact with the leg of a person.

In the construction of an embodiment of the present device, a guard is comprised of an upper component and a lower component. The upper component has a recess that is specially formed so as to interfit with the downwardly projecting leg of the bed frame so as to encase that leg within the guard. The cross member itself is in the configuration of an L-shaped angle iron having a horizontal plane and a vertical plane that depends downwardly toward the floor from the horizontal plane. In one embodiment, an elongated slot is formed in the upper surface of the guard that receives the downward vertical plane of the cross member to align the guard and to hold it in the desired position. As such, therefore, in that embodiment, the upper surface of the guard fits against the underside of the bed frame cross member so that all of the bed frame leg, as well as part of the cross member angle iron is enclosed within the guard. The lower component of the guard, in this embodiment, has an opening into which fits the normal caster or other support so that the caster can be fitted into the bed frame leg in its normal manner to hold the guard in position enclosing the leg of the bed frame.

Thus, in the aforedescribed embodiment, the guard is held in position by the interfitting of the vertical plane of the cross member into the slot formed in the guard as well as the addition of the caster that engages the guard and also interfits to the bed leg that extends down from the cross member.

Accordingly, in a method of installing that embodiment, the standard caster is simply removed from the existing leg, fitting the guard of the present invention to the bottom surface of the bed frame member to cover the leg and receive the downward vertical plane of the cross member and then replacing the caster back into its original position. When the caster is again reattached to the bed frame, the guard is dimensioned such that the same caster can be replaced it its original position and the guard is held in position by the caster itself. As such, therefore, no special tools are required, the caster is still usable and the owner can easily change the guard whenever desired, even to simply affix a different guard for decorative purposes whenever the decor of the room is changed.

Thus, in such embodiment, the guard is dimensioned so as to be fitted over a standard leg of a bed frame and no additional modifications are needed by the user for its installation and, when desired, to replace the guard in the home from time to time as the decorative effect is desired to be varied. The guard can be provided to owners of present bed frames and can be installed without the need for modifications, alterations or the like in order to benefit from the enhanced safety as well as the decorative appeal of the guard of the present invention.

In addition, with the simple approach to installation of the present guard, the user can readily carry out the entire installation in the home without need for special expertise or tools. Accordingly, the guard may be constructed of any number of differing configurations and decorative effects as selected by the homeowner and readily installed without the need for specially qualified persons.

In one alternate embodiment, the guard is a one piece construction and, again, the caster is inserted in a suitable opening in the guard such that the stem of the caster assembly passes through the guard and interfits to the leg of the bed. In this embodiment, therefore, the caster again assists in holding the guard to the bed leg along with the intermitting of the vertical plane of the cross member into the slot in the upper surface of the guard, the difference being that the guard is a one piece structural component as opposed to two components in the preferred embodiment. The installation of the one piece component of this embodiment can be the same as that described with respect to the two piece preferred embodiment. As used herein, the term stem will refer to a member that projects outwardly and is normally used to affix a caster to a leg assembly. In normal practice, there is a metal spindle that is inside a plastic bushing and it is the combination of the metal spindle and the plastic bushing that is inserted into a opening in the leg assembly to affix the caster. Once installed, the caster can be removed and replaced and generally the plastic bushing will remain in the leg assembly of the bed frame. Thus, as used, the term stem, unless otherwise explained, will refer both to the metal spindle and the combination of a metal spindle with the plastic bushing affixed thereto.

In another embodiment, the protective guard is a two piece construction as in the preferred embodiment, however, the stem of the caster assembly is blow molded or injection molded into the lower component of the guard such that the unit can be installed to a cross member of a bed frame by simply interfitting the upper component to the cross member, aligning the vertical plane of the angle iron into the slot in the upper surface of the upper component and then simply interfitting the lower component to the upper component. Since the stem of the caster assembly is already present, having been molded into the structure of the lower component, there is no need to insert a separate caster assembly but merely fit the lower component to the upper component whereby the stem automatically interfits with the leg to hold the guard in position to the cross member. In this embodiment, as well as in the prior embodiments, the leg guard may also be produced without the elongated slot in the upper surface such that the vertical plane of an angle iron need not actually be interfitted onto the bed guard. As such, this, or any other embodiment can be used with other types of bed frame members, such as rolled form steel members.

In a still further embodiment, the guard can be molded in a one piece construction where the entire unit is composed of an injected molded or blow molded plastic and the stem, again, is insert molded into the guard. In this embodiment, the protective guard is a one piece molded construction having the opening in the upper surface to receive the bed leg and the vertical plane of the cross member and the stem is interfitted to the leg without the need to use a separate caster assembly or glide.

In the preferred embodiment, the protective guard is specially adapted to receive a bed leg that is inserted into the opening in the upper surface of the leg guard and the tapering sides of the bed frame leg are supported by similarly angled internal surfaces of the leg guard. The leg guard itself comprises an upper and lower component that are snapped together to make up the overall leg guard. In this preferred embodiment, the vertical plane of the cross member angle does not fit into any slot in the upper surface of the leg guard but instead, the leg guard can be fully affixed to the leg of the bed frame with the vertical plane not touching, far less entering into the body of the leg guard. In addition, in the preferred embodiment, the leg guard is adapted to be used in connection with a specially constructed caster assembly having three spherical rollers so that the bed frame can easily be moved in any direction and have additional strength. That preferred caster assembly is shown and described in copending U.S. patent application, U.S. Ser. No. 09/519,725, entitled CASTER ASSEMBLY FOR A BED FRAME MEMBER OR FURNITURE and the content of the specification of that patent application is incorporated herein by reference.

Thus, in the preferred embodiment, the leg guard is not compatible with the standard conventional casters or glides but is used with an improved caster assembly. In addition, the installation of the leg guard of the preferred embodiment may require simple tools for installation of retrofitted leg guards to already set up bed frames as it may be necessary to remove a plastic bushing from the existing bed frame leg in order to install the preferred leg guard and that removal may require the employment of pliers for such removal, however, again the installation is simple and does not require special tools or installation expertise.

In addition, the preferred embodiment of the leg guard construction provides a caster that is incorporated into the leg guard and thus the user is protected not only from encountering the leg and being injured, but also there is a protection for enclosing the caster itself since the caster in this embodiment is an integral part off the leg guard and only spherical rollers project downwardly to touch the floor. Those spherical rollers are not in a position to be encountered by the user and thus, the present invention provides a protective guard that not only encloses the leg but also the caster assembly for complete protection to the user, that is, with the caster of the present invention, there are no exposed metal parts that can be encountered by the user.

As noted, the preferred material for construction of the protective guard of the present invention is molded plastic since a variety of shapes and surface designs can be readily produced with plastics. Alternatively, however, the protective guard may be other materials such as metal, foamed plastic, rubber, wood, expanded styrene and may be formed in various manners, including blow molding, injection molding or other process and may further be covered with an upholstery applied to the exterior surface for an additional decorative effect. The degree of rigidity is not critical with the protective guard and varying degrees of rigidity can be used since the protective guard is relying more on the outer configuration or shape of the guard and not on the particular materials of its construction to provide the protection and the decorative effect.

Thus, in an integrated construction, the present invention is both a caster that includes a protective guard for that caster and leg as well as a leg and caster guard that incorporates a caster. The one apparatus accomplishes both features by its integrated nature. Also, in the embodiment shown, the caster assembly is affixed to a leg of the bed frame by means of the upstanding stem of the caster being inserted into a corresponding opening in the leg assembly, however, there are obviously other methods of affixing the present protective guard to a leg assembly, including screws or even causing the affixing by means of the weight of the bed frame itself, it only being of importance that the there is an integrated approach such that the caster and the protective shield is an integrated unit that can be affixed to the leg assembly of a bed frame and provide a protective plastic covering to the caster as well as the leg assembly.

As used herein, the terms "caster assembly" or "caster" are intended to not only apply to the use of a caster having a roller but, as will be seen, are equally applicable to the use of a glide or non-rotating support for the bed frame in contact with the floor.

Other features of the guard for a leg of a bed frame will become more apparent in light of the following detailed description of a preferred embodiment thereof and as illustrated in the accompanying drawings.

DETAILED DESCRIPTION OF THE INVENTION

Figure 1A:
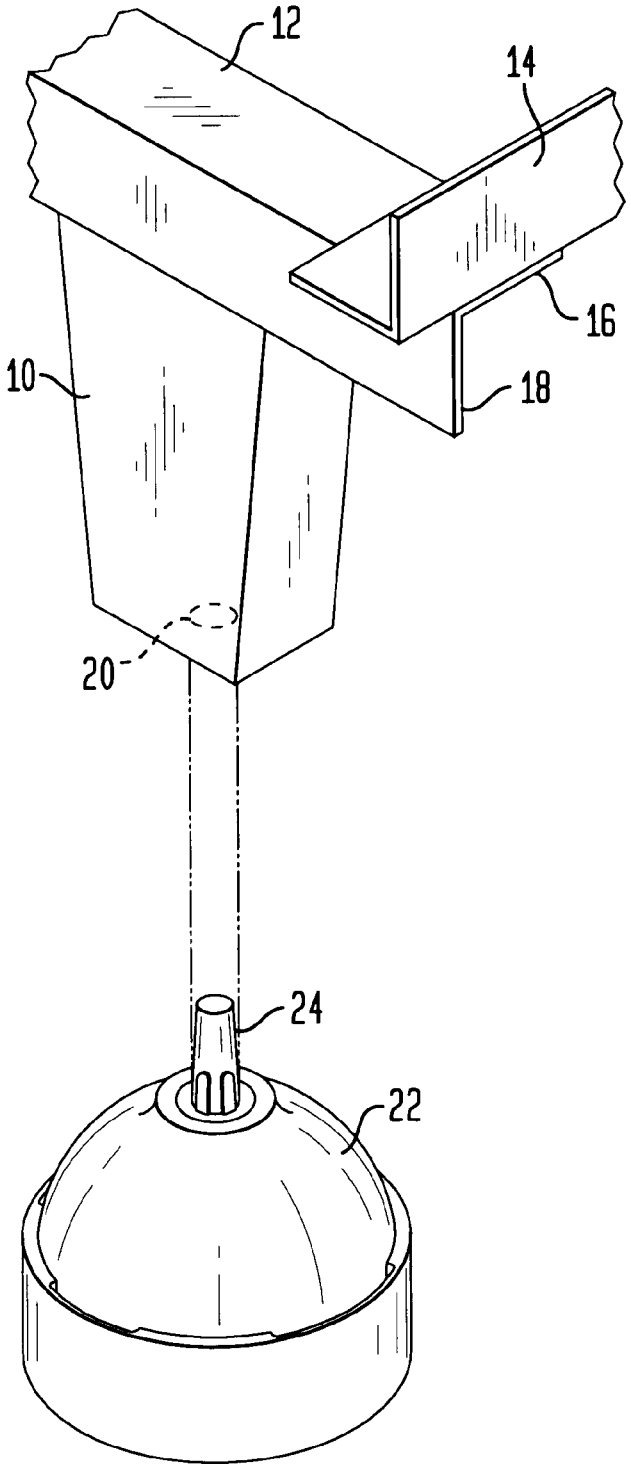
FIG. 1A (PRIOR ART)
FIG. 1A is a perspective view of a leg of a bed frame showing the conventional leg and the means of attaching a caster.

Referring now to FIG. 1A, there is shown a perspective view of a common leg 10 that is used with a bed frame. In the figure, the leg 10 is shown as depending downwardly from a cross member 12 that is, in turn, affixed to a side rail 14 of the bed frame. As will be seen, in the preferred embodiment, the present invention will be described specifically with respect to its use with a bed frame, however, the overall invention is applicable for use with a wide variety of furniture items without departing from the spirit and intent of the invention.

In the assembly and set up of a bed frame, the flames themselves are normally shipped to the user knocked down, that is, the cross members are pivotally affixed to side rails and, during assembly, the cross members are rotated to a point generally at a right angle with respect to the side rails and are then interconnected with a corresponding cross rail from the other side rail. As such, therefore, the legs of the bed frame are generally affixed to the cross members and will be so described herein, it being understood that the present invention may also be applicable to other positions and locations of the legs of a bed frame.

As shown in FIG. 1A, therefore, the typical cross member is conventionally constructed of a steel member having an L-shaped cross section with a horizontal plane 16 that is pivotally affixed to the side rail 14 and a vertical plane 18 of the L-shaped cross member 12 extending downwardly toward the surface on which the bed frame rests. The leg 10, itself, is a stamped steel member that is normal shaped to be tapered in the downward direction, such as in the shape of a truncated trapezoid and has an opening 20 that is of a predetermined standard diameter. The caster assembly 22 may be any variety of caster, however the caster shown is a glide that has a flat bottom and thus is suitable for use with a hard wood or tile floor.

As will be seen, however, the particular caster that can be used with the present invention is not limited to a glide or, for that matter, any other specific caster, it only being of importance that the caster assembly, in the preferred embodiment, include an upstanding stem 24 of predetermined standard diameter, and being slightly tapered, so as to interfit into the opening 20 to thereby become firmly affixed to the leg 10. Again, as noted, the stem here would normally include a plastic bushing that interfits into the opening in the leg, however, with the preferred caster of this invention, the caster need not swivel and therefore, the stem may be metal and force fitted into the leg assembly. Other means of affixing the caster assembly 22 to the leg 10 of a bed frame can be used, however, in the embodiment shown in the drawings and which is quite common, the upstanding stem 24 interfits into the opening 20 and is retrained there by a force fit. As such, the caster assembly 22 can be readily removed by the user and replaced without any special tools or equipment.

Figure 1B:
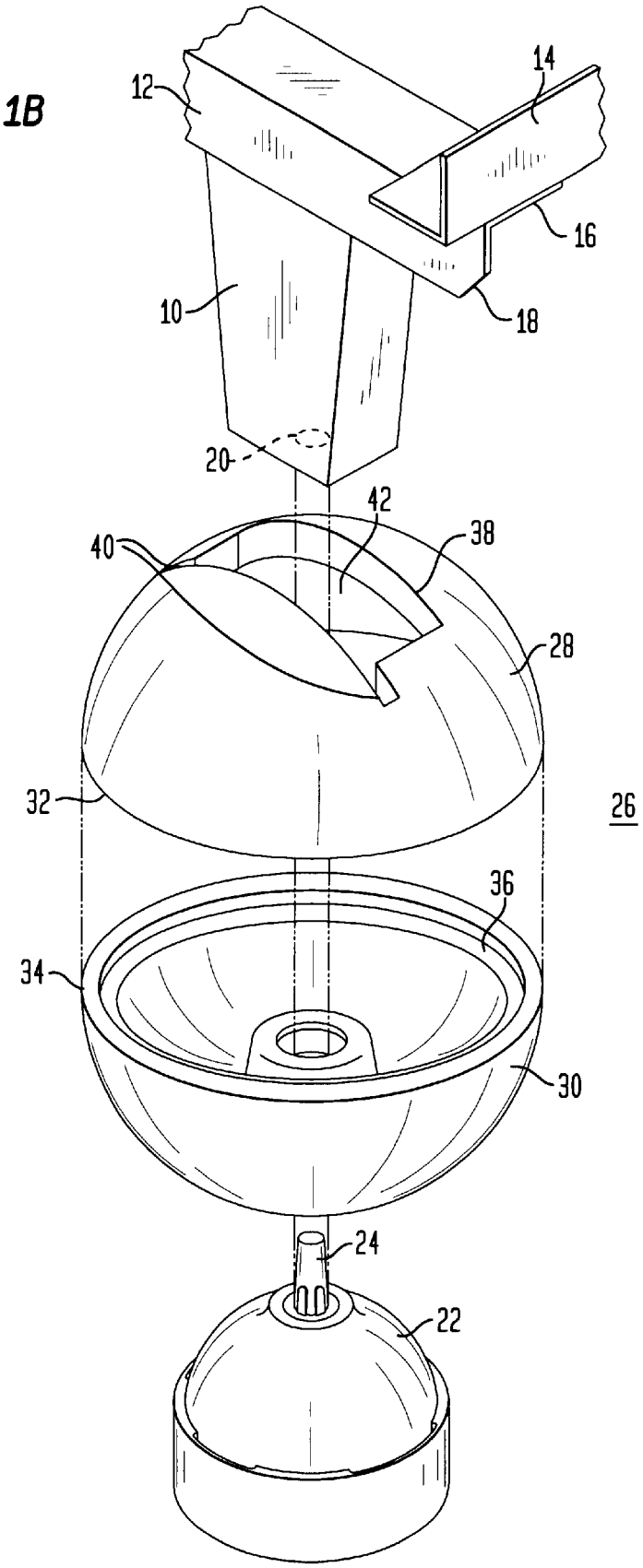
FIG. 1B is an exploded view of a typical leg of a bed frame and illustrating the installation of the protective guard constructed in accordance with the present invention.

Turning now to FIG. 1B, there is shown an exploded view of a leg or support for a bed frame and illustrating the protective guard 26 assembled in accordance with the present invention. As can be seen, the protective guard 26 is, in this embodiment, shaped in the form of a sphere having an upper component 28 that is, as will be explained, interfitted with the leg 10 and a lower component 30. Each of the upper component 28 and the lower component 30 has a similarly shaped peripheral mating surface 32 and 34, respectively, and those mating surfaces 32, 34 interfit together to form the completed protective guard 26 when assembled. The actual mating of the upper component 28 and the lower component 30 may be facilitated by means of a flange and recess on the peripheral mating surfaces 32 and 34, that is, there may be a recess 36 surrounding the mating surface 34 of lower component 30 that interfits with an extending flange (not shown) formed in the mating surface 32 of the upper component 28 so that the upper and lower components 28 and 30 securely and snugly interfit together.

A specially configured opening 38 is formed in the upper surface of the upper component 28 so as to allow the leg 10 to fit into the protective guard 26, when assembled. As can be seen, the opening 38 is comprised of an elongated slot 40 that receives and fits over the downwardly extending vertical plane 18 of the L-shaped cross member 12 and a generally rectangular opening 42 that receives and fits over the leg 10 itself. Thus, by the particular shape of the opening 38, the leg 10 and the vertical plane 18 of the cross member 12 can fit into the upper component 28. During the assembly of the protective guard 26 to the leg 10, therefore, the upper component 28 is fitted over the leg 10 and the vertical plane 1I of the cross member 12 and the lower component 30 combined to form the overall protective guard 26. The caster assembly 22 can then be affixed to the leg 10 by forcing the upstanding stem 24 up into the opening 20 to reattach the caster assembly 22 to the leg 10. As noted, in a first assembly, the stem would normally include a plastic bushing, thereafter it may or may not include the plastic bushing depending on whether the caster assembly has been removed with or without that bushing.

Obviously, as a part to the present invention, the dimensions of the protective guard 26 are important. Thus the overall height or vertical dimension of the protective guard 26 must be such that upstanding stem 24 can fit into and be forced into firm engagement with the opening 20 in the same manner as if the protective guard 26 were not present. In addition, it is important that the outer diameter or dimension of the protective guard 26 be relatively large so there will be sufficient protection to prevent a person from kicking or otherwise striking the leg or other nearby component of the bed frame.

Figure 2:
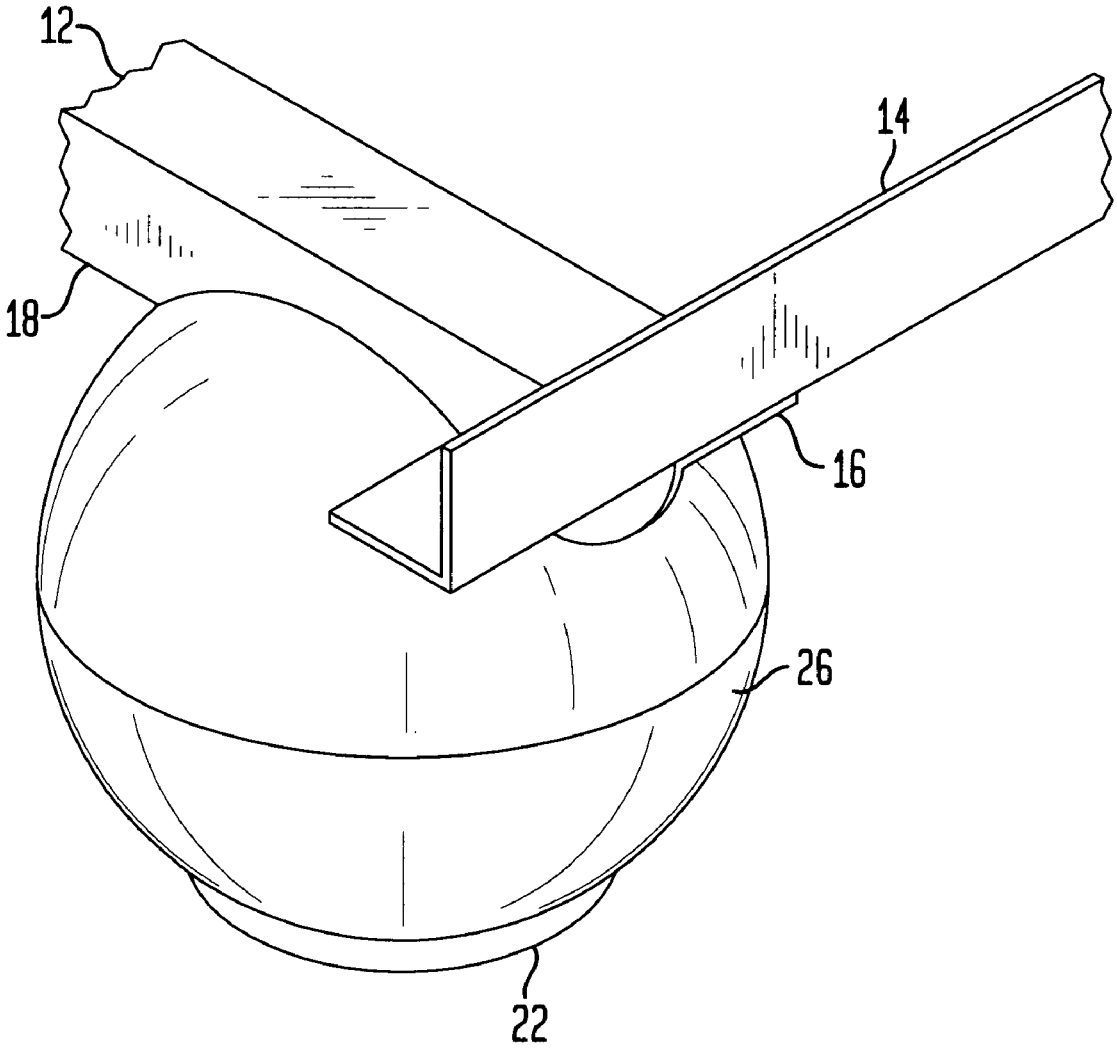
FIG. 2 is a perspective view of the protective guard of the present invention assembled to the leg of a bed frame.

As illustrated in FIG. 2, therefore, there is shown a perspective view of the completed assembly, that is, the protective guard 26 is affixed to the cross member 12 with the leg completely enveloped by the protective guard 26 and thus protective against the striking of the leg of the bed frame by a person. Instead, the person will hit against the safe, smooth outer surface of the protective guard 26 and not be injured.

It should be noted with respect to FIG. 2 that the outer perimeter, or, in the case of the sphere, the outer diameter, of the protective guard 26 is obviously of sufficient size that the person subject to injury will hit the smooth outer surface of the protective guard and not a frame member of the bed frame. In addition, as will be seen, the caster assembly 22 interfits well up into the protective guard 26 by means of a large recess that can be formed in the bottom of the protective guard 26.

Figure 3:
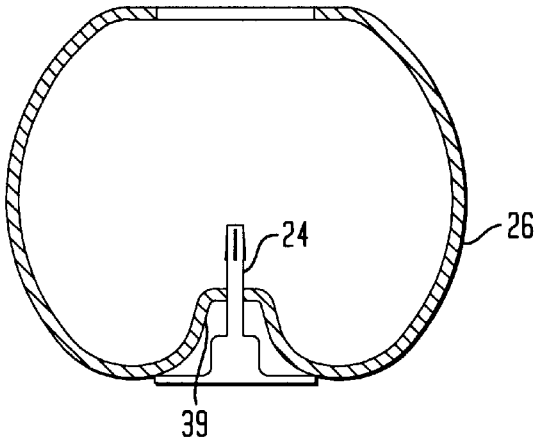
FIG. 3 is a side, cross-sectional view of a one-piece embodiment of the present protective guard.

Turning now to FIG. 3, there is shown a side cross-sectional view of a protective guard 26 that is adapted to be held to the leg of a cross member by means of the stem 24 that, as previously explained, is fitted up into a corresponding fitting or hole in the leg so as to be retained to the leg, thereby holding the protective guard 26 in place affixed to the leg. In the embodiment of this figure, however, the protective guard 26 is a one-piece construction and thus, is simply fitted over the leg of the cross member and the caster assembly 22 fitted up into the recess 39 so as to fit snugly therein. Obviously, the caster assembly 22 of FIG. 3 is a glide, however, the one piece protective guard 26 can be used with a roller caster or other caster used with bed frames.

Figure 4:
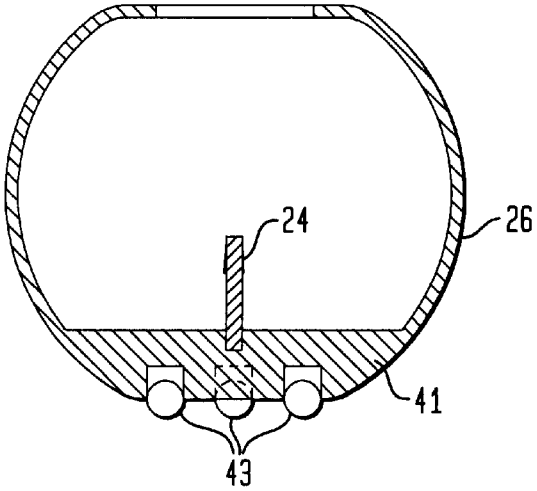
FIG. 4 is a side, cross-sectional view of a still further embodiment of the protective guard.

In FIG. 4, there is shown a side cross-sectional view of a further embodiment of the present invention wherein the protective guard 26 is a one piece construction as described with respect to FIG. 3, however, the upstanding stem 24 is insert molded into the base 41 of the protective guard. Thus, the overall protective guard 26 can be an injection molded plastic construction and the upstanding stem 24 molded into the plastic as the unit is formed, or alternatively, the protective guard 26 can be blow molded. If injection insert molded, the stem will normally be metal, while, if blow molded, the stem will generally be plastic. Again, the portion of the protective guard 26 that contacts the floor may comprise rollers 43 inserted into the base of the protective guard 26. Such roller inserts are commercially available in the form of cartridges and can be force fit into holes in the bottom of the protective guard 26 or molded into the protective guard 26 during the molding process so that the bed frame is mobile and can easily be moved about the room. The rollers can be of the spherical type shown and described in copending U.S. patent application, U.S. Ser. No. 09/519,725, entitled CASTER ASSEMBLY FOR A BED FRAME MEMBER OR FURNITURE, the disclosure of which is incorporated herein.

Figure 5:
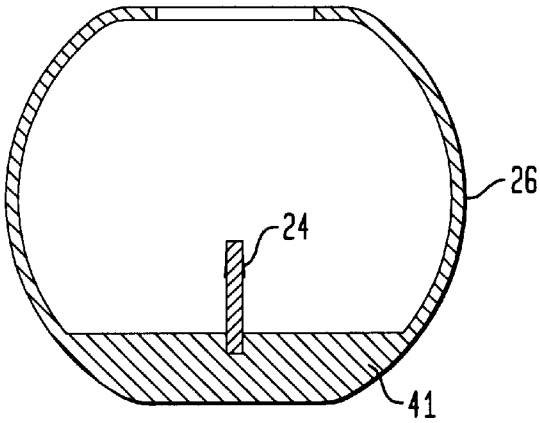
FIG. 5 is a side cross section of a still further embodiment.

Next, in FIG. 5, there is shown a side cross-sectional view of a protective guard 26 constructed of injection molded plastic in a one-piece component similar to the FIG. 4 embodiment, however the bottom on the protective guard 26 is flat surface such that the bed frame is not mobile. Again, however, the protective guard 26 is affixed to the cross member by interfitting of the upstanding stem 24 into an opening in the leg of the cross member.

As can be seen, with the upstanding stem 24 of FIGS. 4 and 5, the protective guard 26 may be a multi piece construction, similar to the FIG. 2 embodiment where the protective guard 26 is comprised of two components. In the case of two components, the molded-in stem would be molded into the lower component of the overall protective guard construction.

Figure 6:
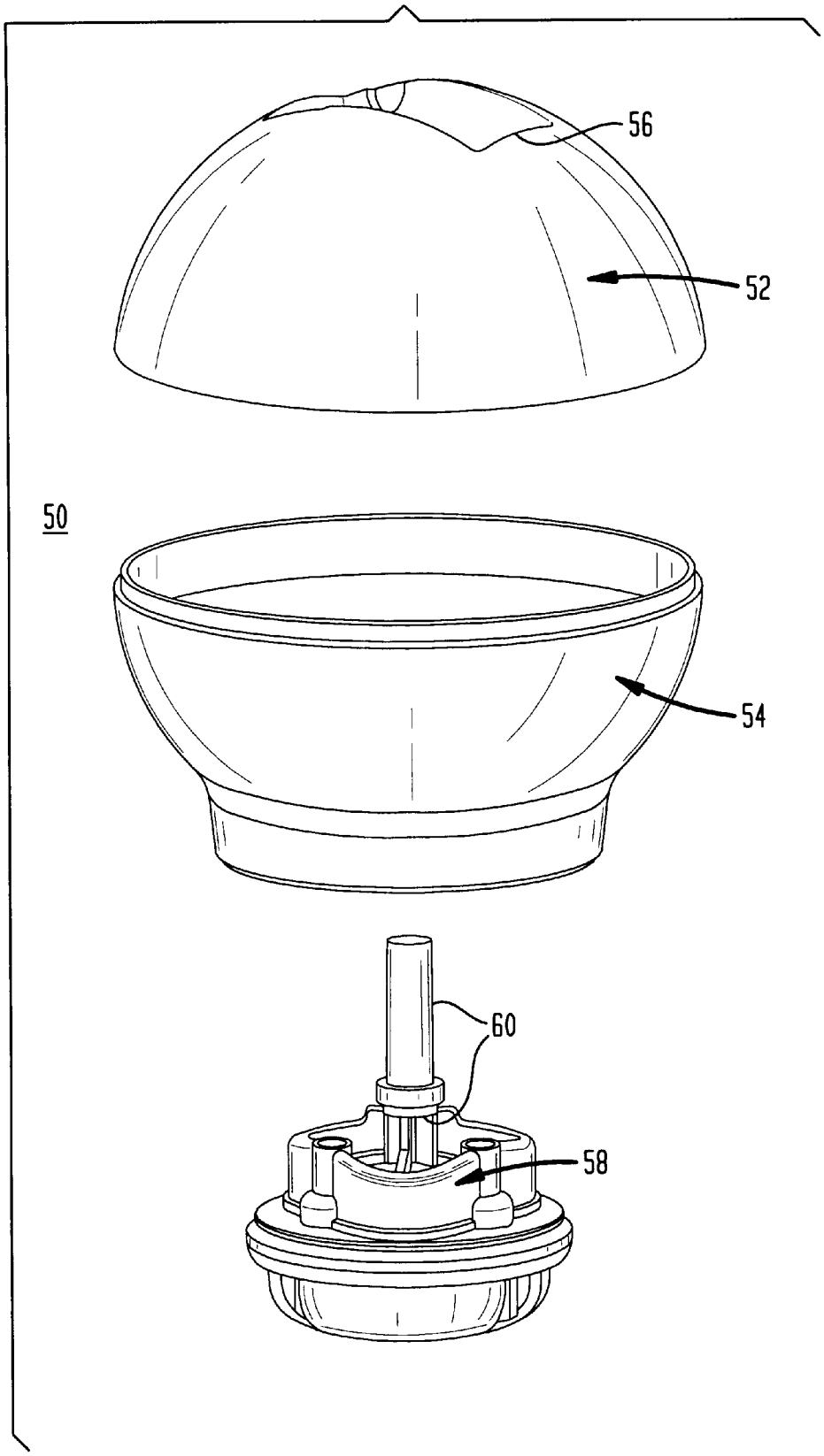
FIG. 6 is an exploded view of the preferred embodiment of the present invention.

Turning now to FIG. 6, there is shown an exploded view of the preferred embodiment of the protective guard 50 of the present invention and where there is an upper component 52 and a lower component 54, again, shown as hemispheres that are fitted together to form a spherical configuration as will be shown. In the upper surface of the upper component 52, there is a rectangular opening 56 that is adapted to receive a bed frame leg as previously explained with reference to the prior embodiments. In addition, there is a caster assembly 58 having a stem 60 that projects upwardly into the protective guard 50 to be affixed to the bed frame leg when assembled to a bed frame.

Figure 7A:
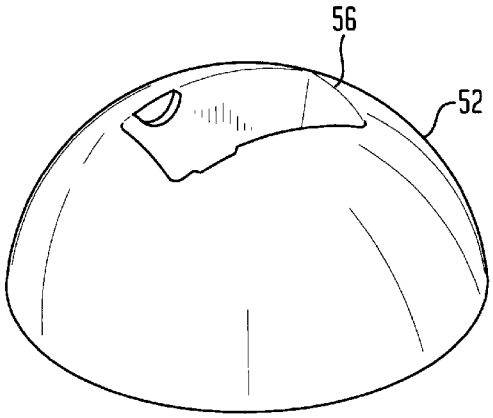
FIGS. 7A and 7B are top and bottom perspective views of the upper component of the invention.
Figure 7B:
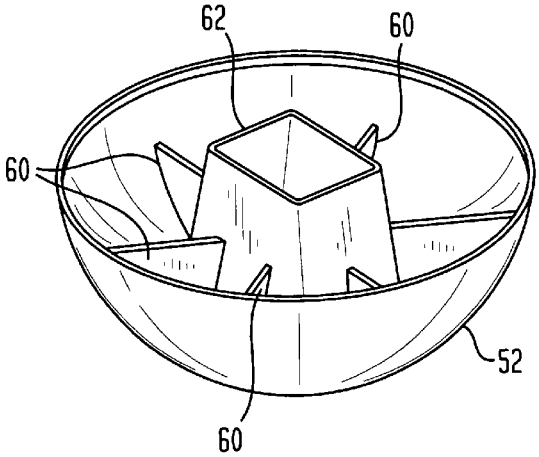

In FIGS. 7A and 7B, there are shown, a top perspective view and a bottom perspective view of the upper component 52 where the rectangular opening 56 is formed in the upper surface of the upper component and, in FIG. 7B, there are a number of reinforcing ribs 60 that lead into the molded supporting receptacle 62 that is generally formed in the shape of a truncated trapezoid and which receives and supports the leg of the bed frame as will be seen.

Figure 8A:
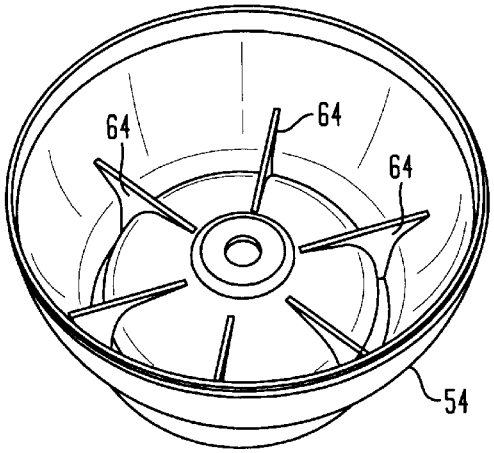
FIGS. 8A and 8B are top and bottom perspective views of the lower component of the invention.
Figure 8B:
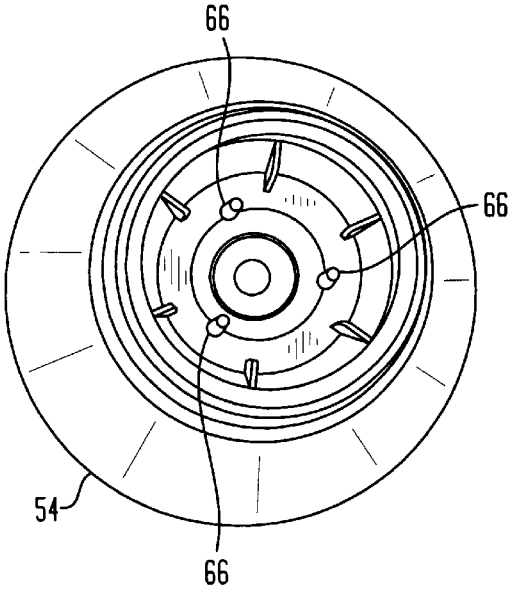

Next, in FIGS. 8A and 8B, there is a top perspective view and a bottom perspective view of the lower component 54 and, as seen, in FIG. 8A, there are further reinforcing ribs 64 for structural integrity and at the bottom surface of the lower component 54, there are a number of bosses 66 having holes to allow the caster assembly (FIG. 6) to be affixed to the lower component 54 of the protective guard 50 by means such as thread forming screws.

Figure 9:
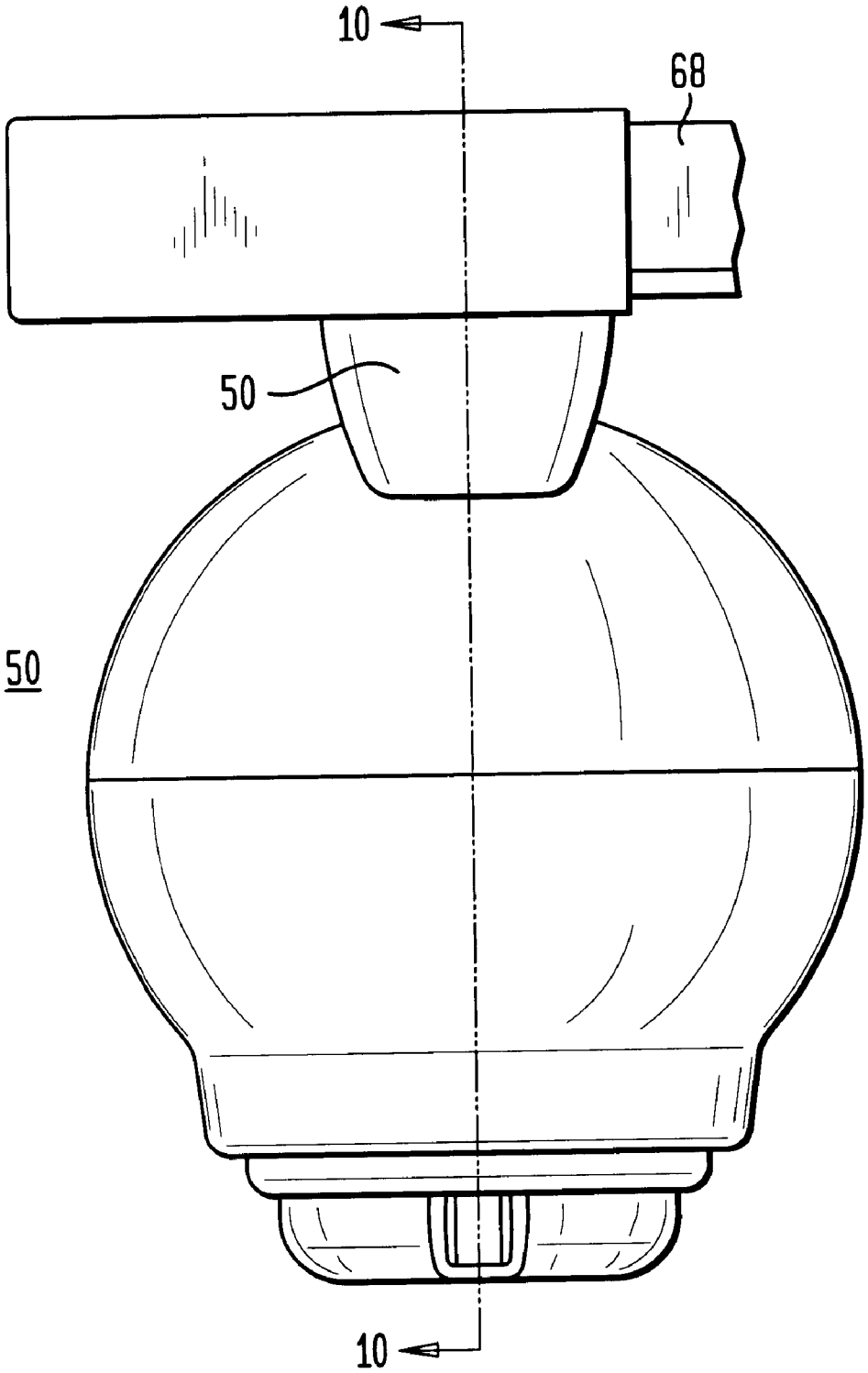
FIG. 9 is a side view of the leg guard of the present invention installed on a bed frame.
Figure 10:
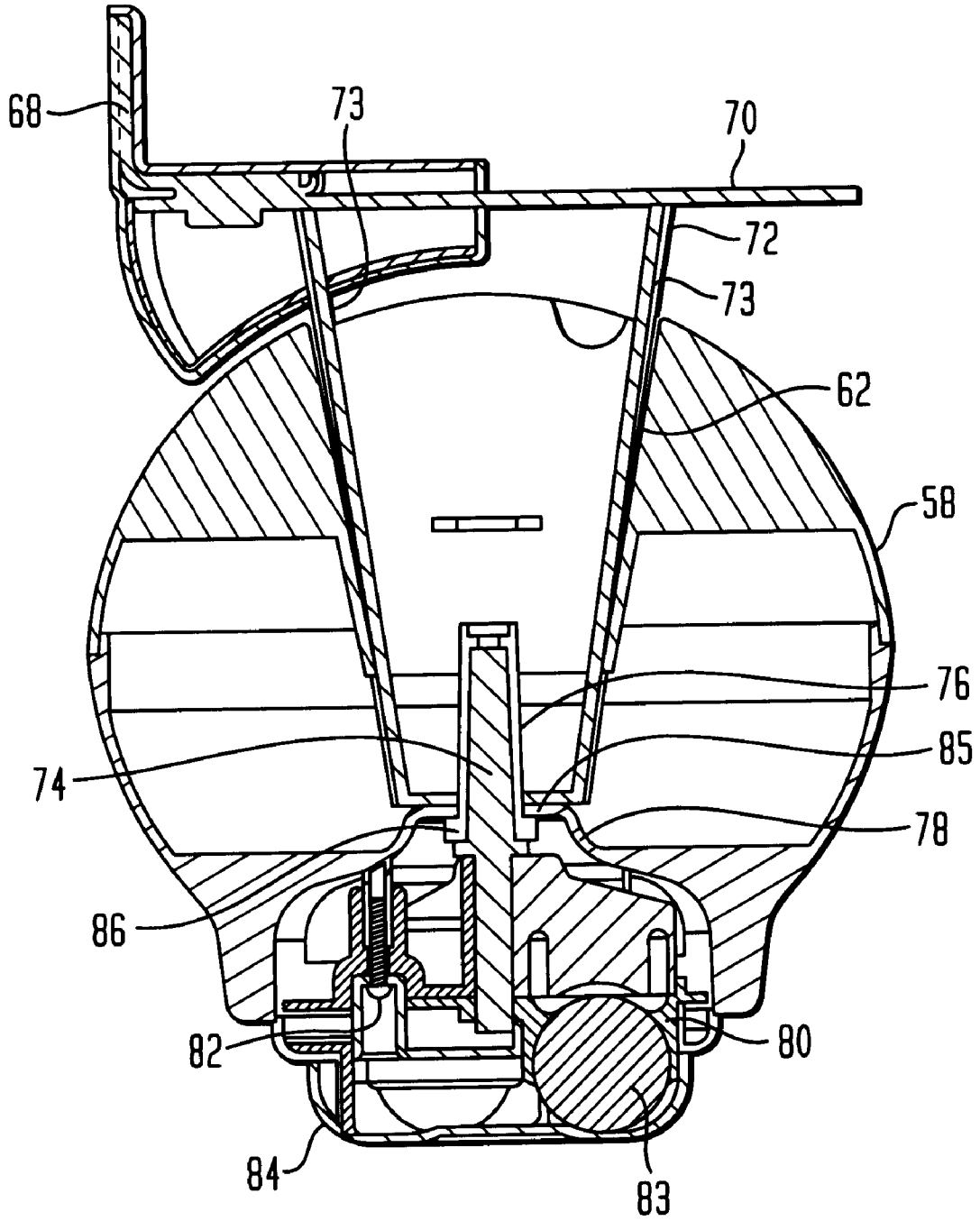
FIG. 10 is a cross sectional view taken along the line 10—10 of FIG. 9.

In FIG. 9, there is a side view of the protective guard 50 of the present invention affixed in position to a bed frame and, as can be seen in this view, the protective guard 50 is located in position at the head of the bed frame, it being used for illustrative purposes. Although the embodiment shown, is specific to a particular location it will be seen that a universal protective guard can be devised that would be adaptable to be used at any location of the legs of the bed frame. FIG. 10 is a side cross sectional view of the embodiment of FIG. 9 taken along the line 10—10 of FIG. 9 and shows the side rail 68 with a cross member 70 joined thereto and a leg 72 extending downwardly from the cross member. As is conventional, the leg 72 comprises a pair of flat steel members 73 that form a generally triangular cross section and having a bottom flat surface with an opening formed therein for affixing the caster assembly 58 to the leg 72.

As can be seen, the leg 72 fits into the supporting receptacle 62 and is supported in the supporting receptacle 62 with the truncated trapezoidal configuration of the leg 72 fitting somewhat loosely into that supporting receptacle 62.

Further in FIG. 10, the caster assembly 58 is a specially constructed caster for the preferred embodiment and comprises an upstanding stem 74 that interfits into the opening in the lower surface of the leg 72 and there is a plastic bushing 76 that is interposed between the upstanding stem 74 and the leg 72. The caster assembly 58 comprises an upper housing 78 and a lower housing 80 that are, together affixed to the lower portion of the lower component 52 by screws 82. Contained between the upper housing 78 and the lower housing 80 are a plurality of spherical rollers 83 that are mounted so as to freely rotate therein such that the caster assembly 58 is free to move in any direction as the bed frame is moved. Preferably, there are three spherical rollers. A glide 84 is removably affixed to the bottom of the caster assembly 58 to provide the function of a glide when desired by the user and the glide is adapted to be easily removed and reattached to allow the user to have the caster assembly 58 act as a roller or as a glide. A lip 85 on the upper portion of the upper housing 78 becomes sandwiched between the lower portion of the leg 72 and the flange 86 on the bushing 76. Thus, as mentioned previously, with the preferred embodiment, in order to retrofit the protective guard 50 to an already existing and set up bed frame it is necessary to remove the bushing 76 so that the leg guard 50 can be sandwiched between the flange 86 and the lower portion of the leg 72. Thus, that operation may require the need for basic tools, such as pliers.

Figure 11:
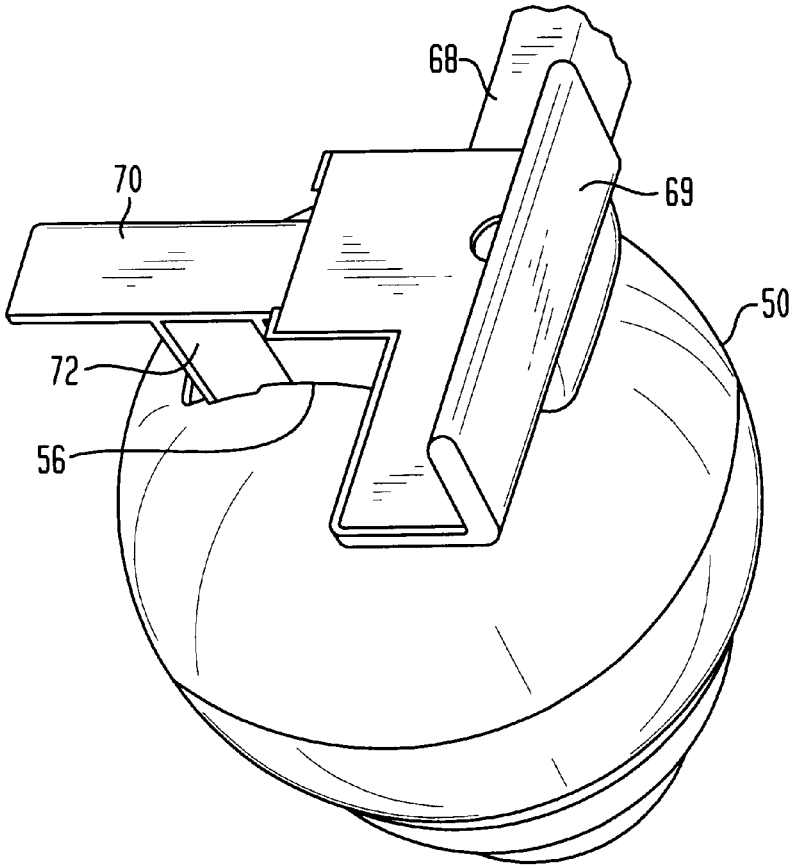
FIG. 11 is a top perspective view of the leg guard of the present invention installed to a bed frame.

Turning to FIG. 11, there is a perspective view of the protective guard 50 affixed to the leg 72 by having the leg 72 project downwardly into the rectangular opening 56 of the protective guard 50. As also can be seen, there is a shield 69 that protects the ends of the side rail and the junction of the cross member and the side rail and that shield is constructed in accordance with the shield disclosed in our U.S. patent application, U.S. Ser. 09/586,345, filed on the same day as the present application and entitled BED FRAME SHIELDS and the disclosure of such application is incorporated herein by reference.

Figure 12:
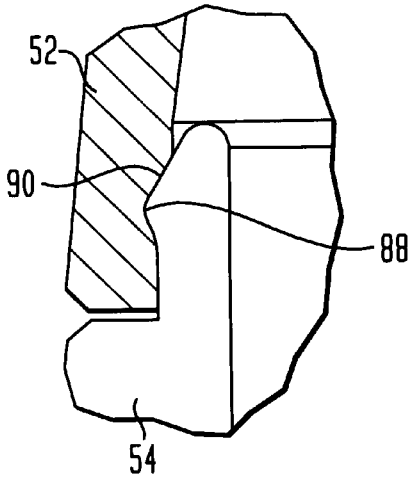
FIG. 12 is an enlarged side cross sectional view showing the juncture of the lower and upper components of the present invention.

In FIG. 12, there is an enlarged side cross sectional view of the means of joining the peripheral edge of the lower component 54 and the upper component 52. As shown, there is and annular projecting rim 88 projecting outwardly from a recessed periphery of the lower component 54 that interfits into a annular recess 90 formed in the internal surface of the lower periphery of the upper component 52. Thus, to assemble the lower component 54 to the upper component 52, the components 52, 54 are merely snapped together without the need for tools or the like to complete the assembly of the protective guard 50.

Thus, with the preferred embodiment, as shown in FIGS. 6–12, the protective guard 50 can be fitted onto the leg of a bed frame and provides a protective covering for that leg to prevent injury to persons otherwise striking the leg. With the protective guard 50, the user is protected from injury and yet there is a decorative feature to the protective guard 50 so the it performs the dual function of providing an attractive alternate to a bare bed frame leg as well as carry out a protective, safety feature to the bed frame.

Figure 13A:
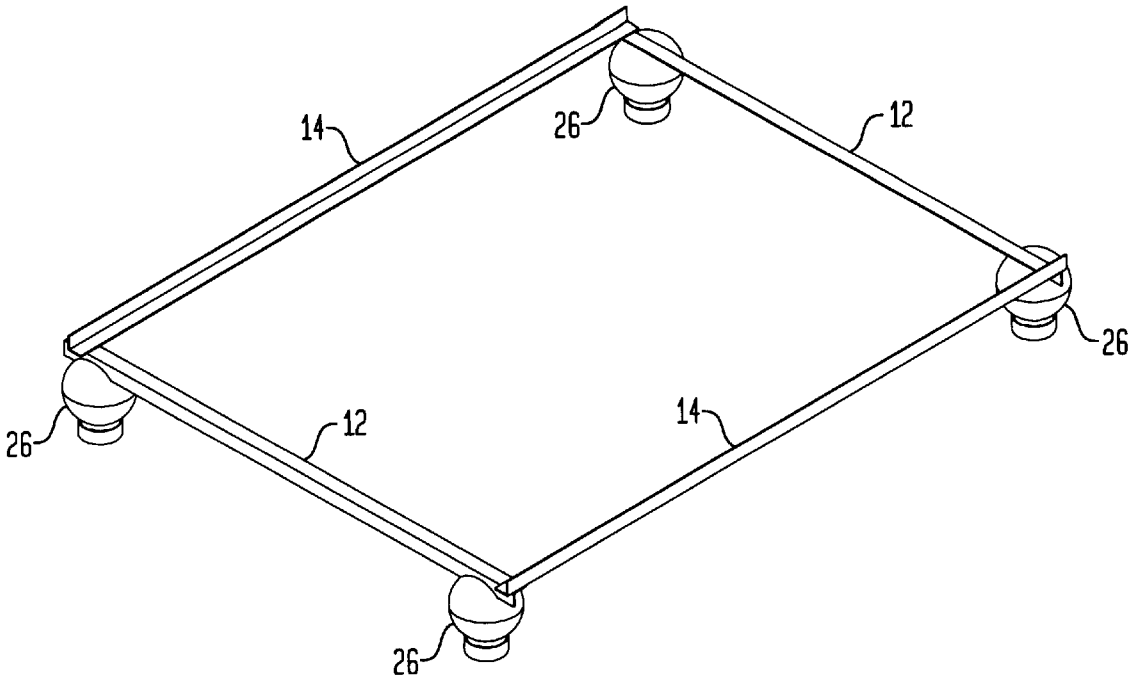
FIGS. 13A–13D are examples of a variety of differing design guards constructed and installed in accordance with the present invention.
Figure 13B:
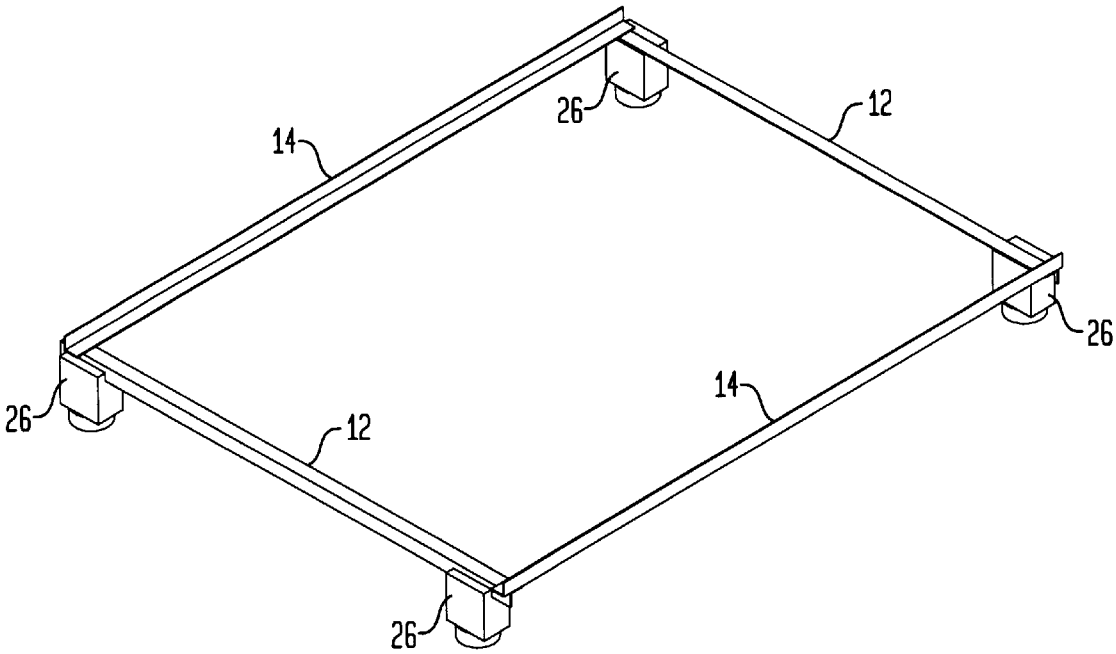
Figure 13C:
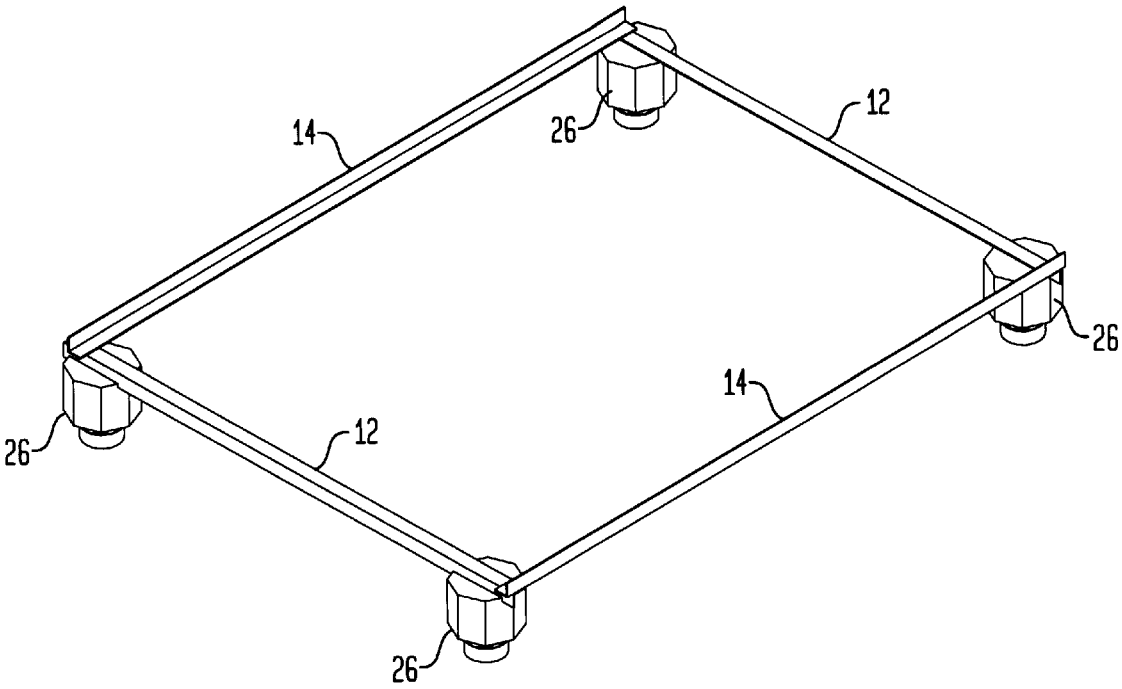
Figure 13D:
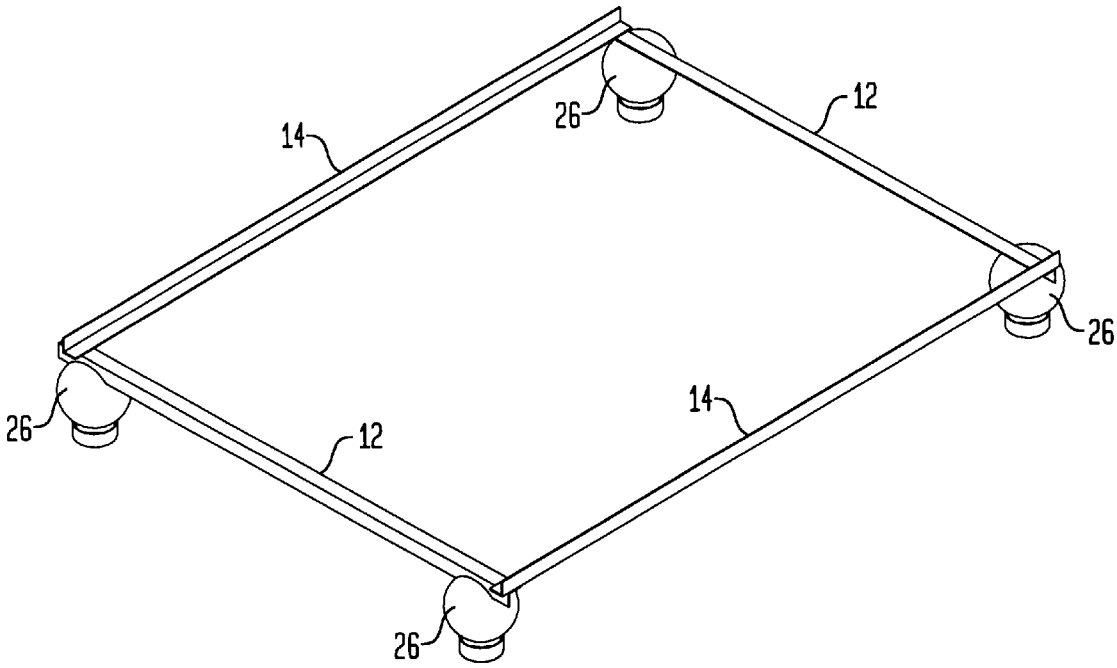

Turning now to FIGS. 13A–13D, there is shown a series of different configurations of the protective guard 26 that are within the scope of the present invention. As can be seen in FIG. 13A, the protective guard 26 is in the shape of a sphere as illustrated in the prior figures. In FIG. 13B, the particular configuration of the protective guard 26 is shaped as a cube. In FIG. 13C, the protective guard 26 is a hexagonal configuration and in FIG. 13D, the protective guard 26 has a particular design on its outer peripheral surface. Thus, not only does the protective guard have a utilitarian function to protect the persons from inadvertently getting injured by hitting the bed frame, but there is a decorative aspect of the present invention inasmuch as the configuration of the protective guard 26 may take on a variety of different looks. If, for example, the room within which the bed is located is decorated in a sports motif, the protective guard may be designed as some sports paraphernalia, such as a baseball, soccer ball, basketball or other item of sports equipment.

Obviously, there are a wide variety of configurations and designs that may be used with the present invention and the protective guard may, as explained, be installed, removed and replaced by the owner easily and conveniently without special tools by simply removing the caster assembly and installing or reinstalling the protective guard and then reconnecting the same caster assembly back into its original location. Thus, the versatility of the protective guard enables the owner to have protection against injury, while at the same time, provide a wide variety of decorative enhancements available to the particular room and have the option to change those enhancements at will as the motif of the room or the taste of the occupant of the room changes.

While the present invention has been set forth in terms of a specific embodiment or embodiments, it will be understood that the protective guard herein disclosed may be modified or altered by those skilled in the art to other configurations. Accordingly, the invention is to be broadly construed and limited only by the scope and spirit of the claims appended hereto.

We claim:

1. A protective guard for surrounding a leg extending downwardly from an angle iron cross member of a bed frame, said protective guard having an upper surface, said upper surface having an opening sized to interfit with and surround the downwardly extending leg, said protective guard having an upstanding stem located in the interior of said protective guard and extending upwardly, said upstanding stem adapted to interfit with and be secured to the leg of the bed frame, said upstanding stem thereby retaining said protective guard to the leg of the bed frame and enclosing the leg within said protective guard.

2. A protective guard as defined in claim 1 wherein said protective guard comprises a spherical configuration.

3. A protective guard as defined in claim 1 wherein said protective guard comprises two components, an upper component and a lower component and wherein said upper and said lower components are adapted to be affixed together.

4. A protective guard as defined in claim 3 wherein said upper and lower components are snapped together.

5. A protective guard as defined in claim 1 wherein said upstanding stem comprising a caster assembly and said protective guard has a lower surface having an opening therein, said caster assembly adapted to retain said guard to said leg when said stem is interfitted to said leg.

6. A protective guard as defined in claim 1 wherein said protective guard is a molded plastic material and said upstanding stem is molded into said protective guard.

7. A protective guard as defined in claim 6 wherein said protective guard is molded in the form of an upper component and a lower component and said upstanding stem is molded into said lower component.

8. A protective guard as defined in claim 1 wherein said protective guard has a lower surface adapted to contact a floor and said lower surface includes at least one roller.

9. A protective guard as defined in claim 8 wherein lower surface includes three rollers.

10. A protective guard as defined in claim 1 wherein said protective guard has decorative indicia on its peripheral surface.

11. A protective guard as defined in claim 1 wherein said protective guard has a generally smooth, curved outer peripheral surface.

12. A protective guard for surrounding a leg extending downwardly from a piece of furniture, said protective guard comprising an upper component having an opening sized to interfit and surround the downwardly extending leg and a lower component adapted to interfit with said upper member to form said protective guard, an upstanding stem affixed to said lower component and extending upwardly within said protective guard, said upstanding stem adapted to interfit with and be secured to the leg of the piece of furniture, said upstanding stem thereby retaining said protective guard to said piece of furniture and enclosing the leg within said protective guard.

13. A protective guard as defined in claim 12 wherein said protective guard is a molded plastic material and said upstanding stem is insert molded into said lower component.

14. A protective guard for surrounding a leg extending downwardly from a piece of furniture, said protective guard comprising a hollow molded material having an opening to interfit and surround the downwardly extending leg, an upstanding stem affixed to said molded material and extend within the hollow interior of said protective guard, said upstanding stem adapted to interfit with and be secured to the leg of the piece of furniture, said upstanding stem thereby retaining said protective guard to said piece of furniture and enclosing the leg within said protective guard.

15. A protective guard as defined in claim 14 wherein said protective guard is comprised of a plurality of components interfitted together.

16. A protective guard as defined in claim 14 wherein said caster assembly is a glide having a generally flat surface contacting a floor.

17. A protective guard as defined in claim 14 wherein said piece of furniture is a bed frame.

18. A protective guard as defined in claim 14 wherein said protective guard is comprised of an injection molded plastic construction.

19. A bed frame, said bed frame comprising a pair of side rails and at least one cross member connecting said side rails, said at least one cross member having a leg extending downwardly therefrom, a protective guard enclosing said leg and having a predetermined minimum external diameter, said protective guard having a caster assembly having at least one roller to contact a floor to support said bed frame, said protective guard adapted to be affixed to said leg, whereby said protective guard provides a protective covering for said caster assembly and said leg.

20. A bed frame as defined in claim 19 wherein said caster assembly includes an upstanding stem and said protective guard is affixed to said leg by means of said upstanding stem affixed to said leg.

21. A bed frame as defined in claim 20 wherein said protective guard has a generally rectangular opening in its upper surface adapted to interfit with said leg.

22. A bed frame as defined in claim 21 wherein said cross member is L-shaped with a downwardly extending vertical plane and wherein said opening further has an elongated slot to receive said vertical plane.

23. A bed frame as defined in claim 22 wherein said leg has an opening adapted to receive said upstanding stem in a force fit to retain said protective guard to said leg.

24. A bed frame as defined in claim 23 wherein said leg is tapered in the direction interfitting with said protective guard.

25. A bed frame as defined in claim 19 wherein said protective guard has an outer decorative surface.

26. A protective guard for surrounding a leg extending downwardly from a angle iron cross member of a bed frame having one plane of said angle iron vertically extending downwardly, said protective guard having an upper surface, said upper surface having an opening sized to interfit and surround the downwardly extending leg, said upper surface further having an elongated slot sized to receive the downward extending vertical plane of the angle iron cross member, a upstanding stem located in the interior of said guard and extending upwardly within said protective guard, said upstanding stem adapted to interfit with and be secured to the leg of the bed frame, said upstanding stem thereby retaining said protective guard to the leg of the bed frame and enclosing the leg within said protective guard.

27. A combination protective guard and caster for use with a bed frame having a leg, said protective guard adapted to be affixed to said leg, said combination protective guide and caster comprising a caster having at least one roller adapted to contact the floor to allow said bed frame to be moved along the floor, said protective guard further including an outer covering adapted to cover said leg and substantially all of said caster.

28. A combination protective guard and caster as defined in claim 27 wherein said at least one roller is a spherical roller.

29. A combination protective guard and caster as defined in claim 28 wherein said at least one roller comprises three rollers.

* * * * *